United States Patent [19]

Dantlgraber

[11] 4,035,105

[45] July 12, 1977

[54] VARIABLE-OUTPUT PUMP CONTROL ARRANGEMENT

[75] Inventor: Jörg Dantlgraber, Lohr (Main), Germany

[73] Assignee: G. L. Rexroth GmbH, Lohr (Main), Germany

[21] Appl. No.: 674,742

[22] Filed: Apr. 7, 1976

[30] Foreign Application Priority Data

Apr. 16, 1975 Germany ..... 2516765

[51] Int. Cl.[2] ..... F04B 49/08

[52] U.S. Cl. ..... 417/220; 417/274; 418/26

[58] Field of Search ..... 418/24, 25, 26, 27, 418/30, 31; 417/274, 220, 221; 60/452

[56] References Cited

U.S. PATENT DOCUMENTS

| | | | |
|---|---|---|---|
| 2,056,896 | 10/1936 | Douglass | 418/26 X |
| 2,238,062 | 4/1941 | Kendrick | 418/26 X |
| 2,740,256 | 4/1956 | O'Malley | 418/26 X |
| 3,467,017 | 9/1969 | Hetz et al. | 418/26 X |
| 3,523,746 | 8/1970 | Dadian et al. | 418/26 |

FOREIGN PATENT DOCUMENTS

| | | | |
|---|---|---|---|
| 2,208,877 | 9/1973 | Germany | 417/221 |
| 1,388,002 | 3/1975 | United Kingdom | 418/26 |

*Primary Examiner*—Carlton R. Croyle
*Assistant Examiner*—Leonard Smith
*Attorney, Agent, or Firm*—Michael J. Striker

[57] ABSTRACT

A variable-output pump has an output-adjusting element which is acted upon by a differential piston arrangement having oppositely facing active surfaces of a smaller and of a larger active area. Control fluid is permanently admitted to the smaller active area of the differential piston arrangement to act on the same and urge the output-adjusting element of the pump toward a low-output position. A biasing spring acts against the force of the fluid acting on the smaller surface, and the control fluid is also selectively admitted to the larger surface to urge the adjusting element toward higher outputs. A control slide controls the admission of the control fluid to the larger surface of the differential piston arrangement and has a housing provided with a bore in which a slide is mounted for movement longitudinally of the bore. The slide has an end face acted upon by the control fluid and another end face acted upon by a spring. The slide has a plurality of compartments separated from one another by lands having control edges. The control fluid flows through the slide into two of the compartments, and a third compartment communicates with a relief conduit. One of the lands cooperates with a port through which the control fluid is admitted to the larger surface of the differential piston arrangement, and one of the control edges on this land has a diverging notch which circumvents this control edge when the land is juxtaposed with the port to permit a limited flow of the control fluid therethrough. The pressure of the control fluid is indicative of the performance of the pump; the fluid pumped by the pump may be used as such control fluid.

16 Claims, 1 Drawing Figure

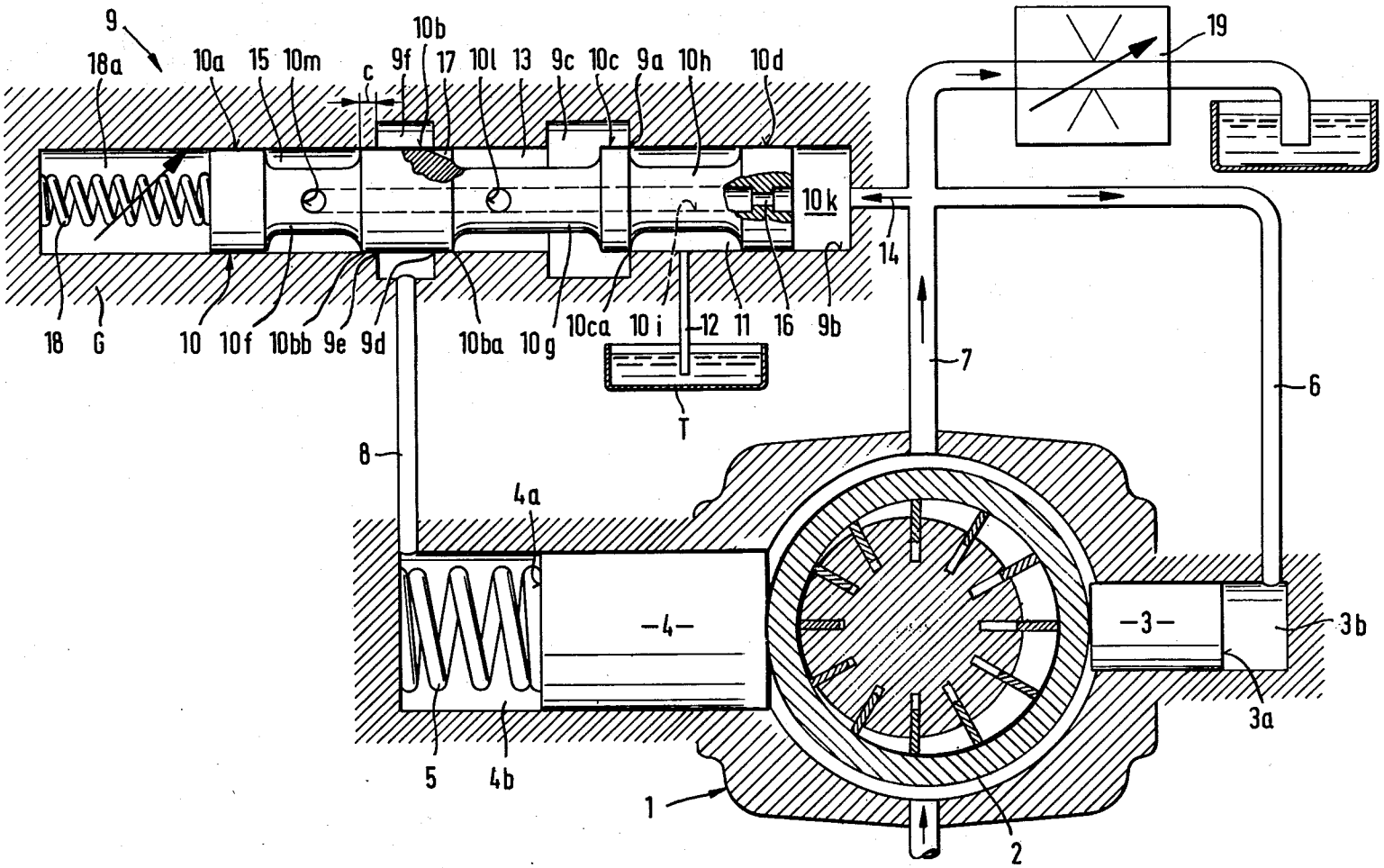
19
6
3b
3a
-3-
2
7
14
10k
9b
16
10d
11
12
10h
T
10i
9a
10c
10ca
9c
10g
13
4a
10l
10ba
4b
17
10b
5
9f
c
9d
8
9e
10m
10bb
15
10f
10a
10
9
18a
G
18
-4-
1

VARIABLE-OUTPUT PUMP CONTROL ARRANGEMENT

BACKGROUND OF THE INVENTION

The present invention relates to a variable-output pump is general, and more particularly to a control arrangement for controlling the output of such a variable-output pump.

Variable-output pumps are already known in the art and, generally speaking, they include an output-adjusting element, be it an inclined plate of an axial piston machine, an eccentric ring of a radial piston machine or similar adjusting elements of other types of pumps. The functional arrangement of the present invention can be used in connection with any of such conventional variable-output pumps, regardless of the particular construction of the pump and the shape, mounting and displacement of the adjusting element. It is sufficient for understanding the present invention to mention that the adjusting element of such a conventional variable-output pump in which the control arrangement of the present invention is to be used is to be displaced in mutually opposite directions in order to increase or decrease the output of the variable-output pump.

There are also already known various arrangements for varying the position of the adjusting element of the variable-output pump in dependence on the operating parameters of the pump. So, for instance, it is well known to use a differential piston arrangement for displacing the adjusting elements between the low-output and high-output position thereof, depending on the load consumed by a user. Such differential piston arrangement usually includes two pistons, one of a larger and another of a smaller active area, which may be separate or combined into a single piston. Such pistons act on the adjusting element of the variable-output pump and displace the same between the low-output and high-output positions. Pressurized control fluid is permanently supplied to the piston of a smaller active area, and only selectively to the piston of the larger active area. A spring may act against the force of the control fluid acting on the piston of a smaller active area and displace the adjusting element toward the low-output position thereof until the pressure of the control fluid exceeds a predetermined threshold value.

There have also been already proposed various arrangements for controlling the selective admission of the control fluid to the piston having the larger active area, such control arrangements usually including a slide valve mounted in a valve housing and assuming different positions depending on the pressure of the control fluid. Under most circumstances, such control slide is a two-position valve which either admits the pressurized control fluid to the piston having the larger active area, or discharges the control fluid from this piston into a relief conduit. However, there have been also proposed some more elaborate slide valve arrangements of different constructions.

The control arrangements for variable-output pumps must satisfy several requirements. First of all, the control operation must be conducted rather rapidly. In other words, the control arrangement must quickly respond to the changes of the operating conditions, such as the load of the variable-output pump, the discharge pressure in the conduit between the variable-output pump and the user of the fluid, or other operating parameters. On the other hand, it is an additional requirement that the amount of hysteresis be rather low, irrespective of the rather high amount of frictional losses in the control arrangement.

In order to satisfy such requirements, it has been already proposed to use a proportional control arrangement. However, experience with this type of an arrangement has shown that a high degree of amplification must be used therein in order to be able to satisfy the above conditions. Furthermore, as a result of the high friction of the elements which take part in the adjusting of the output of the variable-output pump, the control arrangement has a very low stability. When it is attempted to reduce this instability by increasing the damping, the control arrangement becomes too slow.

The above-mentioned conditions and requirements could theoretically be satisfied by using a proportional-differential control arrangement or a proportional-integral control arrangement. However, such control arangements are very complex, expensive and prone to malfunction.

SUMMARY OF THE INVENTION

Accordingly, it is a general object of the present invention to avoid the disadvantages of the prior art control arrangements.

More particularly, it is an object of the present invention to provide a control arrangement which is very rapid in responding to changing conditions and which has a low amount of hysteresis.

It is a further object of the present invention to provide a control arrangement for a variable-output pump which is simple in construction and reliable in operation.

A concomitant object of the present invention is to provide a control arrangement for use with a variable-output pump which is capable of adjusting the output of the pump no matter how rapid the changes in the load of the pump are.

In pursuance of these objects and others which will become apparent hereafter, one feature of the present invention resides, briefly stated, in an arrangement for supplying a fluid to a user, in a combination which comprises a fluid source; conduit means communicating the source with the user; a variable-output pump in the conduit means, having an output-adjusting element and operative for pumping the fluid from the source to the user; means for displacing the element, including a differential piston arrangement having a first surface facing in one direction and a second surface facing in an opposite direction and having a larger area than the first surface, first duct means for permanently admitting a control fluid to the first surface to thereby urge the element toward a low output position, and second duct means for admitting the control fluid to the second surface to thereby urge the element toward a high output position; and means for controlling the adjusting means in dependence upon the pressure of the control fluid, including a slide valve having a housing interposed in the second duct means and having an elongated bore, relief duct means communicating said bore with the source, a slide mounted in said bore for movement longitudinally thereof and having an end face acted upon by the control fluid in one longitudinal direction, biasing means acting on the slide in the other longitudinal direction, the slide having at least two longitudinally spaced control edges, one of which establishes and interrupts communication of said bore with the relief duct means and the other establishes and interrupts the admission of the control fluid to the second surface, and bypass means in one of the housing and the slide and operative for partially circumventing the control edge as the latter approaches the interrupting position thereof. Preferably, the control arrangement is acted upon by the fluid discharged from the variable-output pump so that the pressure of such fluid, which is indicative of the load of the variable-output pump, is used as the measure for adjusting output of the variable-output pump. The adjusting element and the parts connected thereto, and more particularly the differential piston arrangement, may be acted upon by a spring arrangement which displaces the adjusting element of the variable-output pump toward higher outputs thereof.

The control slide may be so constructed that the biasing spring which constitutes the biasing means urges the control edges toward the respective interrupting positions thereof, and that the second control edge reaches and exceeds the interrupting position thereof before the first control edge reaches the interrupting position. The second control edge may be provided on a land of the slide, the housing may have a port which communicates the bore with the second duct means leading to the second surface, and the land may be juxtaposed with and close the port and the second control edge may be spaced a predetermined distance from the port toward the first control edge when the latter is in the interrupting position thereof. The bypass means of a currently preferred embodiment of the present invention includes a notch in the control edge. The notch may diverge in the other longitudinal direction so that it will serve as a variable-flow-through cross-sectional area bypass, the area of which will decrease is the second control edge moves farther beyond the initial interrupting position thereof. In this manner, a variable damping is obtained which is inversely proportional to the deviation from the pre-set median value.

In a currently preferred embodiment of the present invention, the slide has a recessed portion which defines a compartment in the bore. The second duct means admits the control fluid into the compartment, and the control means further comprises a flow restrictor interposed in the second duct means and operative for restricting the flow of the control fluid into the above-mentioned compartment. In this embodiment, the end face of the slide defines a control space in the bore, and the second duct means communicates with the control space. The slide may have a longitudinal blind hole which communicates with the control space, and a transverse hole which communicates the blind hole with the above-mentioned compartment. Preferably, the flow restrictor is arranged in the slide intermediate the control space and the compartment.

The above-mentioned land may separate the above-mentioned compartment from another compartment. In this event, the blind bore may be communicated, via an additional transverse hole, with the other compartment. The above-mentioned land of the slide may include a third control edge adjacent to the other compartment, such a third control edge establishing and interrupting admission of the control fluid to the second surface through the other compartment. Then, the slide may have an additional end which separates the other compartment from an end space of the bore in which a compression spring constituting the biasing means is accommodated.

The first control edge may be provided on a different land of the slide, and the latter may be recessed adjacent to the different land to form a relief compartment. In this embodiment, the relief duct means inclues a relief port which communicates with the relief compartment.

The novel features which are considered as characteristic for the invention are set forth in particular in the appended claims. The invention itself, however, both as to its construction and its method of operation, together with additional objects and advantages thereof, will be best understood from the following description of specific embodiment when read in connection with the accompanying drawing.

BRIEF DESCRIPTION OF THE DRAWING

The single FIGURE of the drawing illustrates, in a diagrammatic fashion, a control circuit in which the slide valve of the present invention is used.

DETAILED DISCUSSION OF THE PREFERRED EMBODIMENT

Referring now to the single FIGURE of the drawing, it may be seen that the reference numeral 1 indicates a variable-output pump having an adjustable element 2 illustrated as a ring. However, it is to be understood that the shape and the adjusting displacement of the adjusting element 2 may be different from that illustrated in the exemplary embodiment. A hydraulically operated displacing piston 4 displaces the adjusting element 2 in the direction of increasing outputs in terms of volumetric rate. On the other hand, a different displacing piston 3 displacing the adjusting element 2 in the direction of decreasing volumetric rate has a surface **3*a* acted upon by a control fluid, the area of which is smaller than an area of a surface 4*a* of the opposite displacing piston 4 which is also selectively acted upon by the control fluid. In addition thereto, a control spring 5 acts on the displacing piston 4 in the direction toward the adjusting element 2. The displacing piston 3 is sealingly accommodated in a control space 3*b*, and a conduit 6 directly communicates this control space 3*b* with a discharge conduit 7 of the variable-output pump 1. On the other hand, the displacing piston 4 is received in a control space 4*b* which is operatively connected, via a conduit 8, with a control slide valve 9. The control slide valve 9 includes a control slide 10 which is subdivided in control slide sections 10*a*, 10*b*, 10*c* and 10*d*. These sections or lands are separated from one another by sections 10*f*, 10*g* and 10*h* of a smaller diameter. The land 10*c* has a control edge 10*ca* which cooperates with an associated control edge 9*a* of the control side valve 9, which is formed by a guide bore 9*b* in which the control slide 10 is mounted for displacement, as well as by a side wall of an annular recess 9*c* provided in a housing G of the control slide valve 9. A compartment 11, which is defined by the section 10*h* of a small diameter together with two of the lands 10*c* and 10*d*, is in communication with a container T, via a relief conduit 12.**

The slide 10 is formed with an axial blind bore **10*i*, and has an end face which defines in the guide bore 9*b* a control space 10*k*. The blind bore 10*i* of the slide 10 is provided with a flow restrictor 16 which restricts the flow of the control fluid through the blind bore 10*i*. A transverse bore 101 is in communication with the axial blind bore 10***i*, and communicates with a compartment 13 which is bounded in the guide bore 9*b* by a section 10*g* of a smaller diameter, as well as by the lands 10*b* and 10*c*, so that such compartment 13 communicates with the control space 10*k*. The latter is connected, via a conduit 14, directly with the discharge conduit 7 of the pump 1.

The land 10*b* has a control edge 10*ba*, and a control edge 10*bb*, each on one axial end of the land 10*b*. The control edges 10*ba* and 10*bb* cooperate with control edges 9*d* and 9*e* which are formed by the guide bore 9*b* and by side walls of an annular recess 9*f*.

In the illustrated position of the slide 10, in which the control edge 10*ca* of the land 10*c* is exactly juxtaposed with the control edge 9*a*, the control edges 10*ba* and 10*bb* of the land 10*b* are spaced from the control edges 9*d* and 9*e* by a distance *c* through which the control slide 10 must be first moved before the space which is defined by the annular recess 9*f*, and into which the conduit 8 which communicates with the control space 4*b* of the displacing piston 4 discharges, can be connected with the compartment 13 or a different compartment 15 which are delimited by the sections 10*g* or 10*f*, respectively.

The compartment 15 which is delimited by the section 10*f* is in communication, via a transverse bore 10*m*, with the blind bore 10*i* and thus with the control space 10*k*. The land 10*b* is formed with an inclined notch 17 which, in the illustrated initial position of the slide 10, communicates the compartment 13 with the annular recess 9*f* and, via the bores 10*l* and 10*i* and the conduit 8, the control space 4*b* of the displacing piston 4 with the control space 10*k* and thus with the discharge conduit 7 of the variable-output pump 1. Thus, in this initial position of the slide 10, the discharged fluid of the pump 1 is admitted to both displacing pistons 3 and 4. As a result of the fact that the displacing piston 4 has a larger surface 4*a* than the surface 3*a* of the displacing piston 3 and, in addition thereto, due to the action of the compression spring 5, the adjusting element 2 is displaced, when the slide 10 is in the illustrated initial position, in the direction of maximum volumetric rate output of the pump 1.

Now, when the pressure in the discharge conduit 7 increases to such an extent that the slide 10 is displaced against the force of a spring 18 which is accommodated in a space 18*a*, the control edge 10*ca* establishes communication between the space or compartment 13 and the compartment 11 and thus with the container T via the conduit 12. As a result thereof, the pressure of the control fluid in the compartment 13 decreases, and so does the pressure of the control fluid in the control space 4*b* of the displacing piston 4. As soon as the pressure of the control fluid in the control space 4*b* decreases to such an extent that the force exerted by the control medium on the displacing piston 4, in combination with the force of the control spring 5, is smaller than the force exerted in the opposite direction by the pressure of the control fluid in the space 3*b* and acting on the displacing piston 3, the displacing piston 3 displaces the adjusting element 2 in direction toward the displacing piston 4 and thus adjusts the variable-output pump 1 toward lower volumetric output rates. This is accomplished for such a period of time until the pressure of the control fluid, that is the fluid derived from the discharge conduit 7 of the pump 1, corresponds to the value which is pre-selected by properly tensioning the spring 18.

The pump 1 supplies the fluid to a user 19, such as a current control device, which is illustrated only schematically, Now, when the user suddenly changes its power demand, for instance by increasing the requirement for the amount of the fluid supplied thereto, whereby the pressure in the discharge conduit 7 decreases by a corresponding amount, the slide 10 is displaced by the force exerted thereupon by the control spring 18 in the direction of the control space 10*k*, and that by such an amount that the control edge 10*bb* establishes communication between the compartment 15 and the annular recess 9*f*, while the control edge 10*ca* interrupts the communication of the compartment 13 with the container T. In this manner, the control space 4*b* is in direct communication with the discharge conduit 7 of the pump 1. In view of the fact that now both displacing pistons 3 and 4 are subjected to the pressure of the fluid in the discharge conduit 7, the force exerted on the adjusting element 2 by the piston 4 exceeds that of the displacing piston 3, so that the adjusting element is adjusted toward the maximum volumetric output rate of the variable-output pump 1.

When the pressure of the fluid in the discharge conduit 7 increases, the immediate connection of the control space 4*b* of the piston 4 with the pressure side 7 of the pump 1 is interrupted by shifting the slide 10 against the force of the control spring 18 and by closing of the control edge 10*bb*, and the control space 4*b* of the displacing piston 4 is connected with the discharge conduit 7 of the pump 1 only through a notch 17 which acts as a damping throttle.

When the user 19 suddenly changes the consumption of the fluid in the downward direction, the pressure in the discharge conduit 7 suddenly increases so that the control slide 10 is displaced against the force of the control spring 18 by a correspondingly large extent. As a result of this, the control edge 10*b* establishes communication of the control space 4*b* with the compartment 13, thus eliminating the function of the notch 17. On the other hand, the compartment 13 communicates with the container T due to the fact that the control edge 10*ca* opens simultaneously with opening the control edge 10*ba*. Thus, the pressure of the control fluid in the control space 4*b* decreases, so that the adjusting element 2 is displaced by the action of the pressurized fluid in the discharge conduit 7 upon the displacing piston 3 in direction toward the minimal output volumetric rate of the variable-output pump 1. As the amount of the fluid pumped by the pump 1 decreases, the pump pressure also decreases so that the slide 10 is displaced by the force of the control spring 18 in direction toward the control space 10*k*.

As soon as the control edge 10*ba* interrupts the communication of the compartment 13 with the control space 4*b*, the compartment 13 communicates with the control space 4*b* only through the inclined notch 17 so that throttling action is obtained in the notch 17 resulting in damping action with respect to further displacement of the displacing piston 4. As a result of the fact that the notch 17 is inclined and thus the flow-through cross-sectional area thereof decreases, the damping effect increases with movement of the slide 10 in direction of the control space 10*k*.

The notch 17 which results in the damping of the movement of the displacing piston 4 also prevents overshooting of the slide 10 and thus a repeated connection of the control space 4*b* directly with the discharge conduit 7 of the pump 1 or with the container T. On the other hand, the displacing piston 4 is very responsive and sensitive to the changes in the pressure of the fluid in the discharge conduit 7, regardless of the rapidity of such changes. A particular advantage is to be seen in the fact that the damping comes into existence only then when the adjusting operation which is to be controlled is already almost terminated.

It will be understood that each of the elements described above, or two or more together, may also find a useful application in other types of constructions differing from the types described above.

While the invention has been illustrated and described as embodied in a variable-output pump control arrangement, it is not intended to be limited to the details shown, since various modifications and structural changes may be made without departing in any way from the spirit of the present invention.

Without further analysis, the foregoing will so full reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for supplying a fluid to a user comprising, in combination, a fluid source, conduit means communicating said source with a user; a variable-output pump in said conduit means, having an output-adjusting element and operative for pumping the fluid from said source to the user; means for displacing said element, including a differential piston arrangement having a first surface facing in one direction and a second surface facing in an opposite direction and having a larger area than said first surface, first duct means for permanently admitting a control fluid to said first surface to thereby urge said element toward a low-output position, and second duct means for admitting the control fluid to said second surface to thereby urge said element toward a high-output position; and means for controlling said adjusting means in dependence on the pressure of the control fluid, including a slide valve having a housing interposed in said second duct means and having an elongated bore, relief duct means communicating said bore with said source, a slide mounted in said bore for movement longitudinally thereof and having an end face defining a control space in said bore and acted upon the control fluid in one longitudinal direction, and biasing means acting on said slide in the other longitudinal direction, said slide having at least two longitudinally spaced control edges a first of which establishes and interrupts communication of said bore with said relief duct means and a second of which establishes and interrupts the admission of the control fluid to said second surface and a recessed portion which defines a compartment in said bore, said second duct means including one duct portion permanently admitting the control fluid into said control space, said slide having a longitudinal blind hole communicating with said control space and a transverse hole communicating said blind hole with said compartment, said blind hole and transverse hole together constituting another portion of said second duct means, said control means further including means for restricting the flow of the control fluid into said compartment, including a flow restrictor arranged in said slide intermediate said control space and said compartment and interposed in said other portion of said second duct means; and bypass means in one of said housing and slide and operative for partially circumventing said second control edge as the latter approaches the interrupting position thereof.

2. An arrangement for supplying a fluid to a user comprising, in combination, a fluid source; conduit means communicating said source with a user; a variable-output pump in said conduit means, having an output-adjusting element and operative for pumping the fluid pump from said source to the user; means for displacing said element, including a differential piston arrangement having a first surface facing in one direction and a second surface facing in an opposite direction and having a larger area than said first surface, first duct means for permanently admitting a control fluid to said first surface to thereby urge said element toward a low-output position, and second duct means for admitting the control fluid to said second surface to thereby urge said element toward a high-output position; and means for controlling said adjusting means in dependence on the pressure of the control fluid, including a slide valve having a housing interposed in said second duct means and having an elongated bore, and a port communicating said base with a portion of said second duct means leading to said second surface, relief duct means communicating said bore with said source, a slide mounted in said bore for movement longitudinally thereof and having an end face defining a control space in said bore and acted upon by the control fluid in one longitudinal direction, and biasing means acting on said slide in the other longitudinal direction, said slide having at least one land and at least two longitudinally spaced control edges a first of which establishes and interrupts communication of said bore with said relief duct means and a second of which is provided on said land and establishes and interrupts the admission of the control fluid to said second surface, said land being juxtaposed with and closing said port and said second control edge being spaced a predetermined distance from said port toward said control edge when the latter is in the interrupting position thereof, said land separating one compartment in said slide from another compartment, said slide having passage means communicating said control space with said compartments; and bypass means in one of said housing and slide and operative for partially circumventing said second control edge as the latter approaches the interrupting position thereof.

3. An arrangement as defined in claim 2, wherein said land has said second control edge thereon adjacent said one compartment; wherein said slide further includes a third control edge on said land adjacent said other compartment which establishes and interrupts admission of the control fluid to said second surface through said other compartment.

4. An arrangement as defined in claim 3, wherein said slide has an additional land which separates said other compartment from an end space of the bore; and wherein said biasing means includes a compression spring accommodated in said end space.

5. An arrangement for supplying a fluid to a user comprising, in combination, a fluid source; conduit means communicating said source with a user; a variable-output pump in said conduit means, having an output-adjusting element and operative for pumping the fluid from said source to the user; means for displacing said element, including a differential piston arrangement having a first surface facing in one direction and a second surface facing in an opposite direction and having a larger area than said first surface, first duct means for permanently admitting a control fluid to said first surface to thereby urge said element toward a low-output position, and second duct means for admitting the control fluid to said second surface to thereby urge said element toward a high-output position; and means for controlling said adjusting means in dependence on the pressure of the control fluid, including a slide valve having a housing interposed in said second duct means and having an elongated bore, relief duct means communicating said bore with said source, a slide mounted in said bore for movement longitudinally thereof and having an end face acted upon by the control fluid in one longitudinal direction and at least two control edges a first of which establishes and interrupts communication of said bore with said relief duct means and a second of which establishes and interrupts the admission of the control fluid to said second surface, and biasing means acting on said slide in the other longitudinal direction and urging said control edges toward the respective interrupting positions thereof, said second control edge being so spaced from said first control edge in said one longitudinal direction that it reaches and exceeds said interrupting position thereof before said first control edge reaches said interrupting position thereof; and bypass means in one of said housing and slide and operative for partially circumventing said second control edge as the latter approaches the interrupting position thereof.

6. An arrangement as defined in claim 5, and further comprising auxiliary biasing means urging said element in said one direction.

7. An arrangement as defined in claim 5, wherein said auxiliary biasing means acts on said differential piston arrangement.

8. An arrangement as defined in claim 5, wherein said second control edge is provided on a land of said slide; wherein said housing has a port communicating said bore with said second duct means leading to said second surface; and wherein said land is juxtaposed with and closes said port and said second control edge is spaced a predetermined distance from said port toward said first control edge when the latter is in the interrupting position thereof.

9. An arrangement as defined in claim 5, wherein said first control edge is provided on a land of said slide; wherein said slide is recessed adjacent to said land to form a relief compartment; and wherein said relief duct means includes a relief port communicating with said relief compartment.

10. An arrangement as defined in claim 5, wherein said first duct means communicates with said conduit means intermediate said pump and the user to be supplied with the control fluid therefrom.

11. An arrangement as defined in claim 5, wherein said second duct means communicates with said conduit means intermediate said pump and the user to be supplied with the control fluid therefrom.

12. An arrangement as defined in claim 5, wherein said bypass means includes a notch in said control edge.

13. An arrangement as defined in claim 12, wherein said notch diverges in said other longitudinal direction.

14. An arrangement as defined in claim 5, wherein said slide has a recessed portion which defines a compartment in said bore; and wherein said second duct means admits the control fluid into said compartment.

15. An arrangement as defined in claim 14, wherein said control means further comprises a flow restrictor interposed in said second duct means and operative for restricting the flow of the control fluid into said compartment.

16. An arrangement as defined in claim 15, wherein said end face of said slide defines a control space in said bore; wherein said second duct means has a portion which communicates with said control space; and wherein said slide has a longitudinal blind hole communicating with said control space, and a transverse hole communicating said blind hole with said compartment.

* * * * *